US005581942A

United States Patent [19]

Sill et al.

[11] Patent Number: 5,581,942

[45] Date of Patent: Dec. 10, 1996

[54] METHOD FOR THE INSTALLATION OF A SASH IN THE FRAME OF A ROOF WINDOW

[75] Inventors: Michael Sill, Leinfelden-Echterdingen; Siegfried Müllerbader, Filderstadt, both of Germany

[73] Assignee: Roto Frank AG, Leinfelden-Echterdingen, Germany

[21] Appl. No.: 426,284

[22] Filed: Apr. 21, 1995

[30] Foreign Application Priority Data

Apr. 21, 1994 [DE] Germany ..... 9406636 U

[51] Int. Cl.[6] ..... E05D 15/40

[52] U.S. Cl. ..... 49/253; 49/153; 52/200

[58] Field of Search ..... 49/253, 246, 153; 52/72, 200

[56] References Cited

U.S. PATENT DOCUMENTS

| | | | |
|---|---|---|---|
| 4,106,237 | 8/1978 | Bierlich | 49/253 X |
| 4,217,732 | 8/1980 | Reichstadt | 49/253 X |
| 4,449,327 | 5/1984 | Nielsen | 49/253 X |
| 4,480,406 | 11/1984 | Frank | 49/153 |
| 4,486,978 | 12/1984 | Frank | 49/153 |

*Primary Examiner*—Philip C. Kannan
*Attorney, Agent, or Firm*—Pepe & Hazard

[57] ABSTRACT

A connecting assembly for installing the sash of a house skylight to the sides of its casement, has connecting parts that can pivot relative to each other, and the casement has holding elements that have cross sections which will engage therewith. This assembly allows the window sash to be inserted from the interior rapidly and in a simple manner by engagement with the positioning arms on the casement. This is achieved by the connecting parts (3) having a U-shaped cross section (4), which accept swinging positioning arms (5) which serve as the holding elements, and these connections can be locked by self-engaging attachment elements (6) that can be engaged without tools.

12 Claims, 6 Drawing Sheets

METHOD FOR THE INSTALLATION OF A SASH IN THE FRAME OF A ROOF WINDOW

BACKGROUND OF THE INVENTION

The present invention relates to a connecting device for installation of the sash of a house skylight in the casement, whereby the sash is axially fixed to the side pieces, but it has connecting parts which pivot and holding elements for the casement, that assemble perpendicularly in a form fitting manner.

When a skylight is installed in a roof, it is advantageous, because of the weight of the window, to install the casement and the sash in sequence. For this purpose, connecting elements of a connecting device must be present that make it possible to install the sash into the already installed casement from the inside in the simplest possible way.

A connecting device of the kind mentioned in the introduction is known from DE-GM 8,490,192. This connecting device consists of arc shaped guides attached to the casement and arc shaped slide rails that are arranged so as to rotate at the window sash. The parts must be fitted together when the sash is installed and secured later by another part to be screwed on. This connection device is unsuitable for simple and rapid installation of the sash in the casement, especially if the sash is to be attached to positioning arms that swing.

A house skylight is known from DE-P 2,519,856, in which the sash is connected to the casement by means of the positioning arms. The positioning arms are linked to the upper edge of the casement on one end and in the middle of the length of the side pieces of the sash on the other end. In the region of the upper third of the length of each of the side pieces, an axle hub is mounted that is intended to slide along the upper edge of the casement. If the sash is attached to the positioning arms, the sash moves when opened in a hinged motion about the linking axle of the positioning arms, which is located above it on the casement side. If the sash is detached from the positioning arms, the axle hubs on the casement slide while the positioning arms are lifted down from the casement. Thus, the linking of the positioning arms about which the sash can be swung is located in a high position, and the free viewing height is increased. The sliding movement of the axle hubs is limited by insertion of a strike insert.

The invention is based on the task of further developing a connecting device of the type mentioned in the introduction in such a way that a sash can be connected from the inside simply and rapidly, with swinging positioning arms mounted on the casement.

SUMMARY OF THE INVENTION

The task is solved according to the invention by having the connecting parts in a U-shaped cross section, accept swinging positioning arms that serve as holding elements, and these connections being lockable by attachment elements that can be activated without tools.

The sash is inserted, e.g., from the inside through the casement built into the roof, placed on the upper edge of the casement and brought into the correct position with respect to the casement. Here, for example, the axle hubs on the sash sides lay on the strike pieces and determine the correct positioning. Now, however, the connecting parts and the positioning arms are connected together, for example, by pushing the sash side with the U-shaped cross section over the free end of the positioning arm, which has a special rectangular cross section. This connection between connection parts and positioning arm can then be secured by a hand activated attachment element.

The connection device according to the invention can be produced economically as a piece punched from sheet metal, and it can be mounted with few hand movements. Even with sashes of larger dimensions, the work of installing the sash can be done by one person, especially if the axle hubs lie on the strike inserts.

The attachment elements can be constructed in various ways. A simple solution can be built from a bolt that can be inserted into a hole that goes through both the connecting part and the positioning arm in the desired position.

In a preferred manner, at least one bolt is mounted with a spring so that it can not be lost, which can be pulled back when the positioning arm is inserted into the U-shaped cross section with an insertion bevel on the connection parts and engages in the locked position with an indentation in the connection part in a form fitting manner. This embodiment has the advantage that the parts automatically engage with one another in the locked position, and the installation step is basically limited to bring the positioning arms to cover the connecting parts, whereby the insertion of the positioning arms into the U-shaped cross section in the connecting parts is made easier by insertion bevels on the connecting parts.

A further embodiment of the attachment elements consists of providing latches that effect a locking of the connecting parts and the positioning arms in the coupled end position.

In a favorable manner, the latches on the positioning arms are mounted so as to swing, whereby they engage in the locked position with at least one closing knob in corresponding indentations in the connecting parts. It is appropriate to make the indentations in the form of a slit and to provide each of the closing knobs with at least one bevel, by which means insertion of the closing knobs into the corresponding indentation of the U-shaped cross section is made easier, and a fit between connecting part and positioning arm is achievable to press the adjustment into the locked position completely against the bottom of the U-shaped cross section of the cross section. By implementing the attachment elements with swinging latches, it is possible to achieve locking with a simple hand action. In this way, no tool is needed for installation of the sash and securing the connection between connecting part and positioning arm.

By means of a strike plate arranged on the positioning arm, which corresponds to a curved indentation of the rod, the range of motion of the latch can be limited to the installation position or the locked position.

Inadvertent unlocking is prevented by having the latches, after installation of the sash, attached by bringing an upper weatherstripping to be attached to the positioning arm in the locked position.

An adjustment possibility can be added to the connecting device, in which the position of the connecting part can be shifted lengthwise with respect to the positioning arm by means of an eccentric bolt.

Preferably, the eccentric bolt runs between two positioning arms perpendicular to the lengthwise axis; it is arranged within the limits applied to the connecting parts, and the eccentric shaft is connected to the positioning arm. With this adjustment possibility, the position of the sash can be set with respect to the casement. Thus, setting of the position of the sash along the positioning arm as well as a perpendicular setting is possible, in order to provide easy access even to a casement installed at a steep angle.

Inserts can also be provided that also secure the position of the connecting parts on the positioning arm and, in particular, serve to keep it held reliably on the positioning arm after unlocking by loosening by attachment element of the sash.

The window frame, which is generally made of wood, is usually protected against moisture by weatherstripping. Here, an upper weatherstripping can also cover the positioning arm and a lower weatherstripping must engage with it and cover the lower portion of the window frame. With such an embodiment with the ends of adjoining weatherstripping overlapping, the connecting part is provided with free spaces that form a free space for access to the end region of the lower weatherstripping when the sash swings.

DETAILED DESCRIPTION OF THE PREFERRED EMBODIMENT

Figure 1:
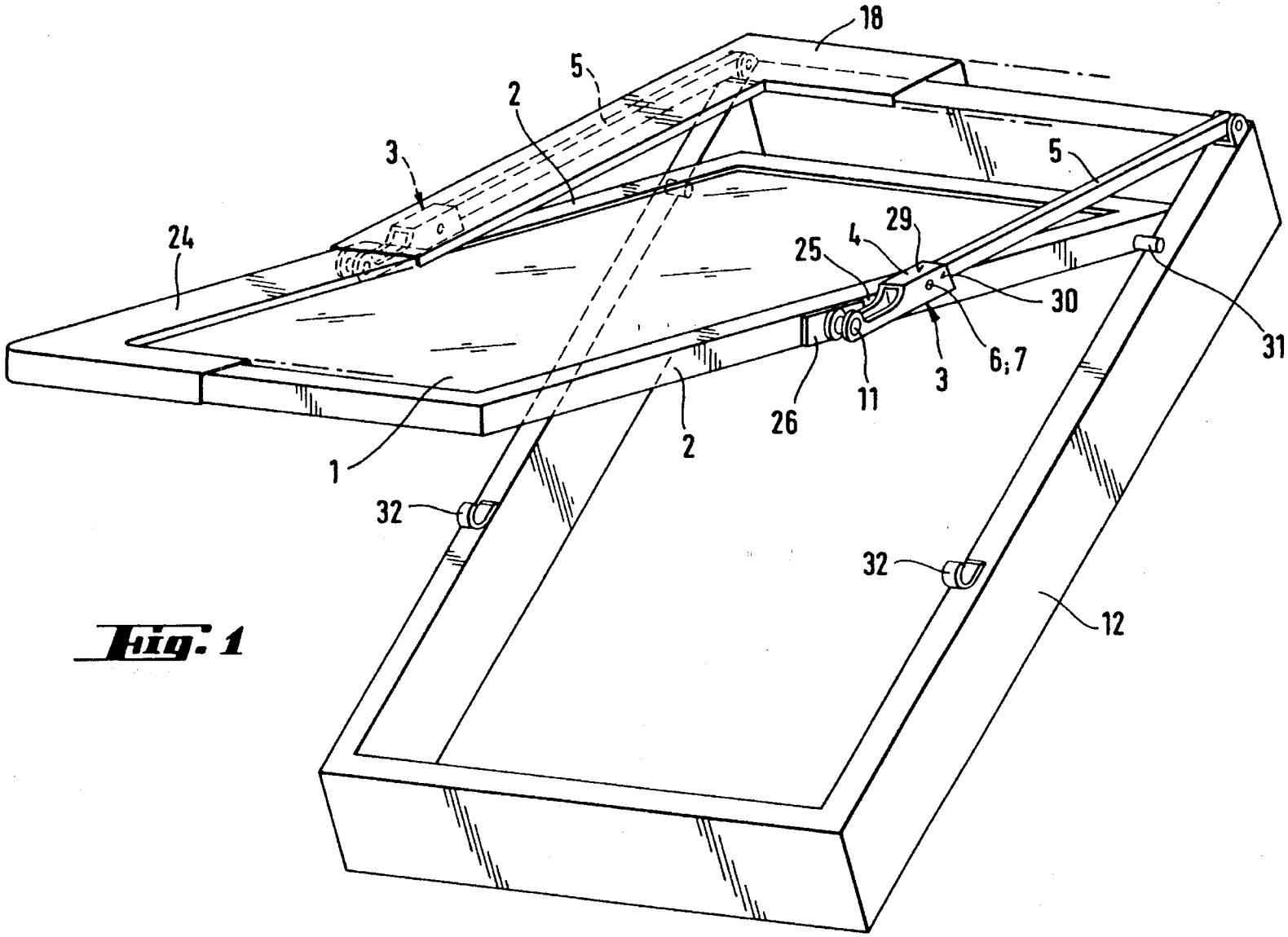
FIG. 1 shows a skylight embodying the present invention with positioning arms partially pivoted related to the casement and the sash.

The skylight in FIG. 1 consists of the casement (12), onto which a pair of positioning arms 5 is mounted so they can swing, the free ends of which hold a sash 1 that can be swung. The sash 1 is provided with connecting members (3) on both its side rails 2, which have a U-shaped cross section 4, in which accept the positioning arms 5 with their free ends in a form fitting manner. An attachment element (6) locks the connection between the connecting part (3) and the associated positioning arm (5). The connecting part (3) is attached by a plate (26), which can be seen in FIG. 2, which is attached to the side rail 2. The U-shaped body portion (4) and the axle (11) are mounted to the plate (26) so that the connecting member pivots thereabout.

Above the positioning arm (5) and the upper part of the casement (12) there is an upper weatherstripping (18) formed to provide a U-shaped channel. In the region of the connecting members (3), the upper weatherstripping (18) covers with its lower end, the upper end of a lower weatherstripping (24), which protects the edges of the sash (1) in the lower region. The lower weatherstripping (24) ends above the axle (11), whereby the connecting members (3) are provided with free spaces (25) in such a way that the axle (11) of the swinging sash (1) can complete its motion without the upper ends of the lower weatherstripping (24) colliding with the connecting members (3).

When the sash (1) swings open, the axle hubs (31) on the side rolls 2 of the sash, slide onto the front surface of the casement (12) from below, whereby the axis of rotation of the sash, which consists of the axle (11), is lifted from the casement (12). When the axle hubs (31) lie on the strike piece or catches (32), the sash (1) is in the cleaning position, in which the outer side of the sash (1) is accessible from the inside.

Figure 2:
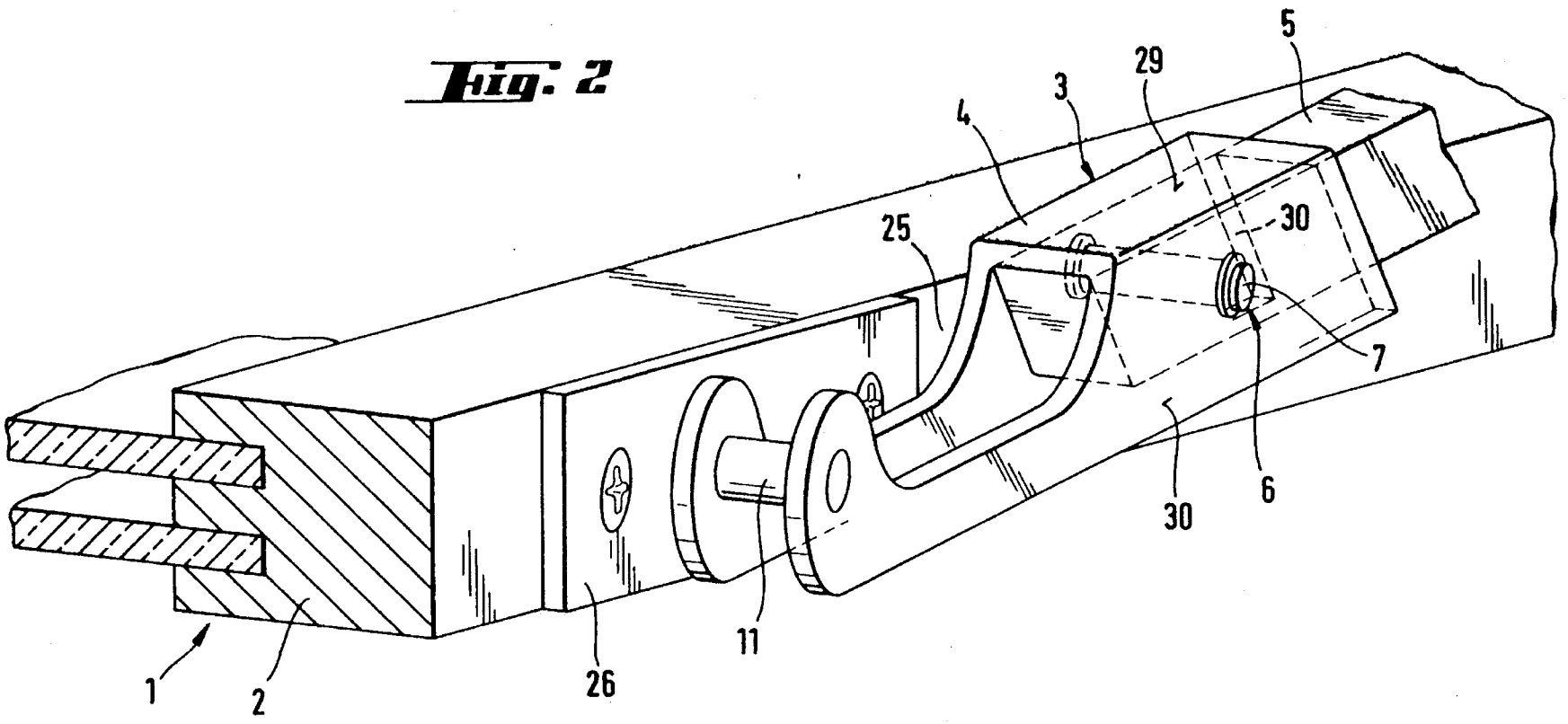
FIG. 2 is an enlarged fragmentary view of the skylight of FIG. 1 with a first example of an embodiment of the connecting device.

The enlarged representation according to FIG. 2 is to be understood so that the U-shaped back portion (4) of the connecting member (3) receives the positioning arm (5) with its free ends in a form fitting manner. A bolt (7) serves as the mounting element (6), which locks the positioning arm (5) to the connecting member (3). The bolt (7) can have a head for security, and on the other side it can be held by means of a securing such as a nut or the like.

Figure 3:
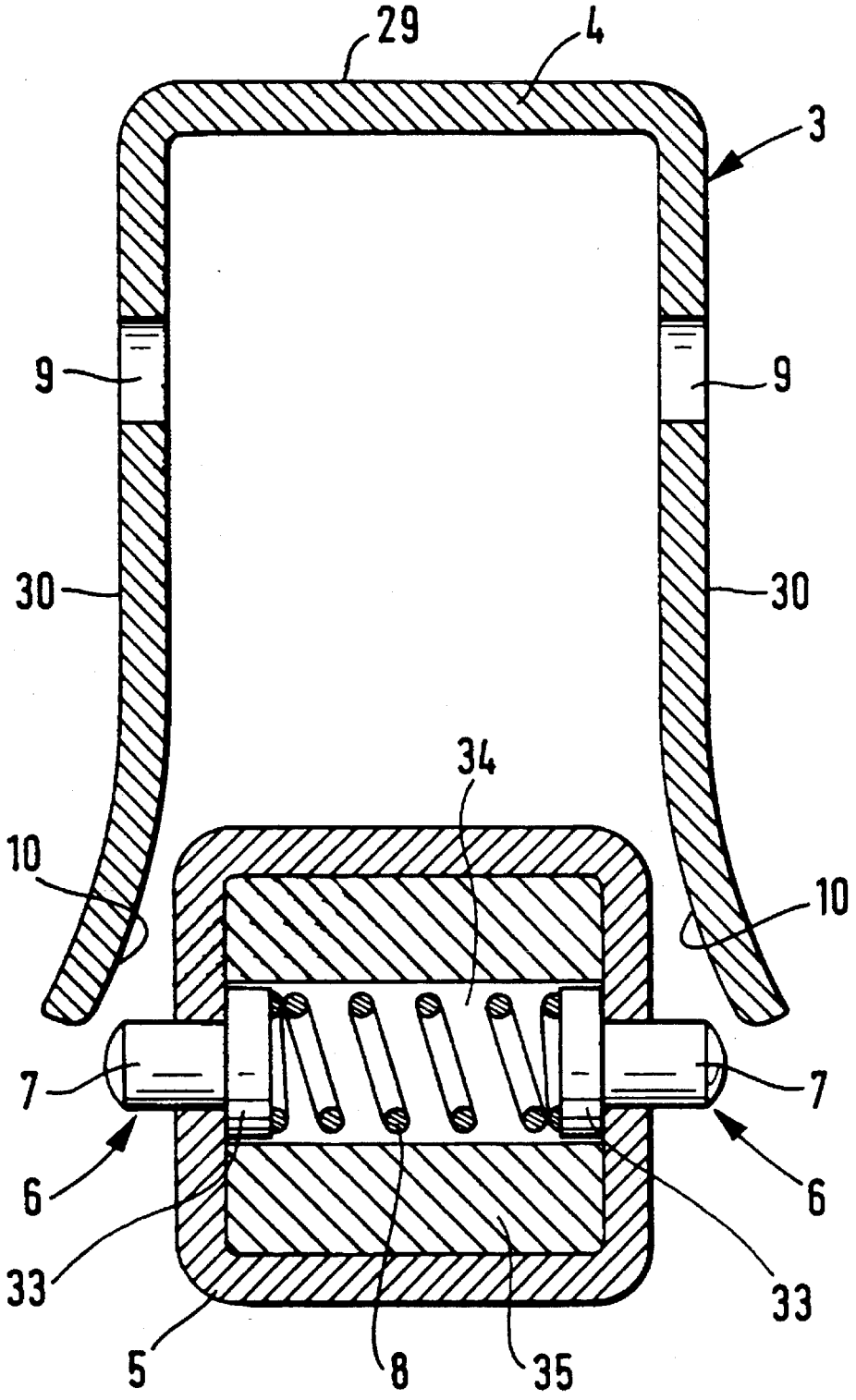
FIG. 3 is a cross sectional view of an embodiment of an attachment element.

The connecting member (3) in FIG. 3, which is provided with a U-shaped body portion (4), is positioned in the region of a mounting element (6) with insertion bevels outwardly flowing edge portions 10 to facilitate. Adjacent the free ends of the positioning arms (5), there are two bolts (7) as mounting elements (6) against the pressure of a spring (8) placed there between in the profile of the positioning arms so that they can be pressed into the connecting member 3. The bolts (7) have an enlarged head (33) in a bore (34) in the free cross section of the insert (35) which is pushed into the positioning arm (5). The insert (35) which has the shape of a rectangular tube, and the bore 34 also accepts the spring (8). When the positioning arms (5) are brought in to the connecting members (3), the bolt (7) is pushed back into the positioning arms (5) by the cam surfaces (10) against the force of the spring (8). When the positioning arms (5) reach their desired position in which the positioning arm (5) abuts the bottom surface or web (29) of the connecting member (3) connected to the free shaft (3) in the U-shape shaped cross section (4), then the bolts (7) are aligned with the apertures (9) made in the side walls (30) of the U-shaped body portion (4), the bolts (7) automatically engage therein through the force of the spring (8). This embodiment is especially simple and appropriate, since simple insertion is sufficient and the mounting elements (6) automatically engage in the locked position.

Figure 4:
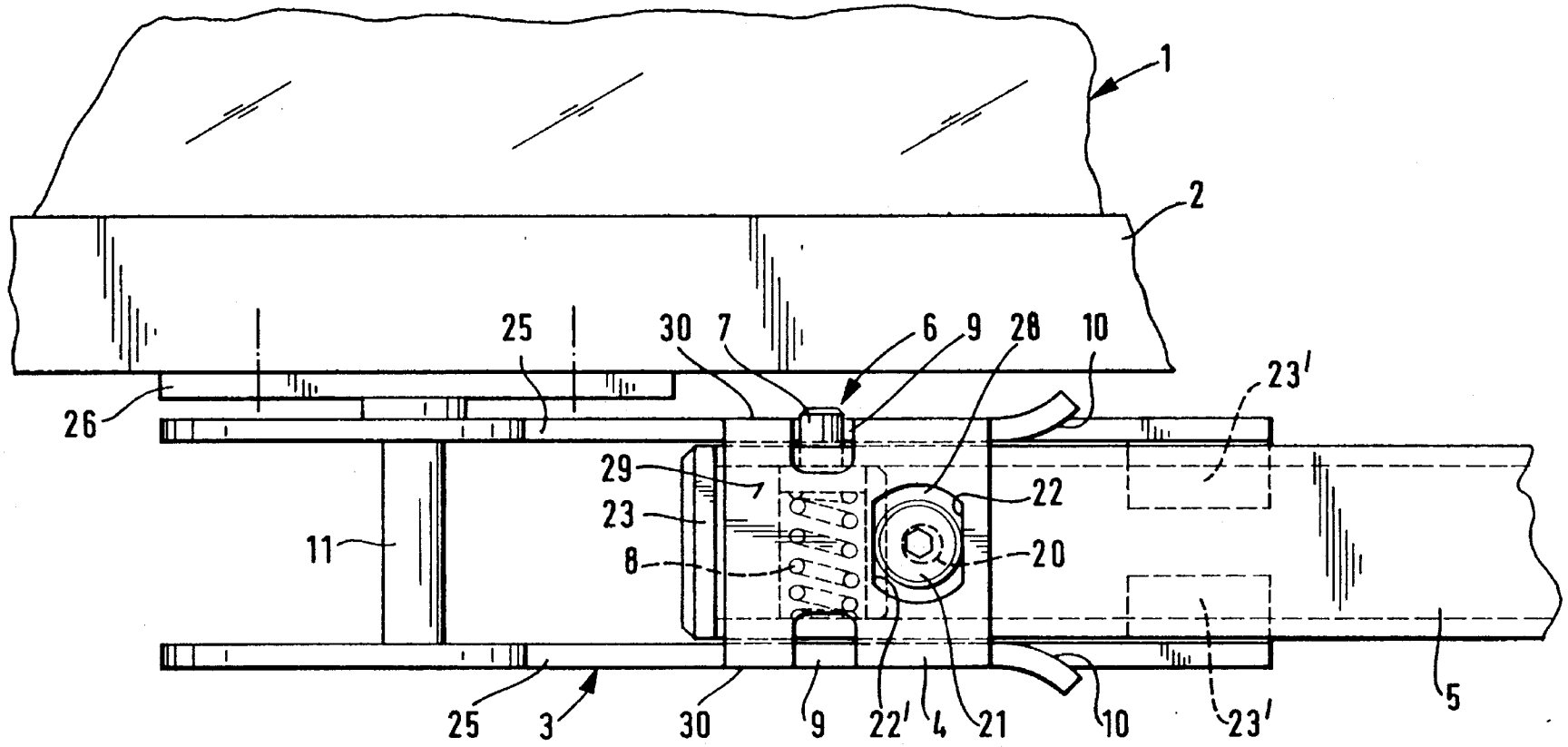
FIG. 4 is a top view of a second embodiment of a connecting device.

In the connection device according to FIG. 4, the positioning arm (5) has only one bolt (7), and the connecting member (3) is provided with two flared end wall portions (10) and two openings or apertures (9), so that the U-shaped body portion (4) can be inserted on the left and right. In addition, the connecting member (3) has two inserts (23 and 23'). The insert (23) is inserted at the front end of the positioning arm (5) in such a way that it lies opposite the bottom surface or web (29) of the U-shaped body portion (4) of the connecting member (3). This insert (23) serves as a guide for determining the correct arrangement of the connecting member (3) with respect to the positioning arm (5) in connecting these parts (3, 5) and also in disconnecting them, even after unlocking by loosening the attachment elements (6) as an additional security means, in order to prevent the connecting member (3) from sliding away from the positioning arm (5). Inserts 23' are attached to the U-shaped body portion (4) and engage its open side in such a way that the positioning arm (5) is almost completely enclosed on all sides in this position.

At the bottom surface (29) of the U-shaped body portion (4), the connecting member (3) is brought into an elongated aperture (28) that has side edges (22, 22') that lie perpendicular to the long axis of the positioning arm (5). An eccentric bolt (21) is mounted between in the aperture 28 between the side edges 22, 22'), the eccentric shank (20) of which is riveted to the positioning arm (5) so it can rotate. Both the bolt (7) in the opening (9), which serves as an mounting element (6), and the insert (23) have play, so that a shift of the connecting member (3) on the positioning arm (5) in its long direction is possible by moving the eccentric bolt (21). The position of the sash (1) is thereby adjustable with respect to the casement (12). By positioning the eccentric bolts (21) on the two positioning arms (5) in equivalent positions, the spacing between the upper and lower edges of the sash (1) and the casement (12) can be regulated. By means of various positions of the two eccentric bolts (21), a correction of the diagonal position of the sash (1) is possible.

In FIG. 4, the axle (11) of the connecting member (3) is also shown at the side rail (2) of the sash (1). The sash (1) with the side piece (2) is only fragmentarily illustrated. The plate (26) serves to attach the axle (11) of the connecting member (3) to the side rail (2), whereby this plate (26) is shaped as a plate that is attached to the side rail (2) with screws through it. Additional fitting pins serve for precise attachment. The axle (11) forms at the same time an axis for the swinging of the sash (1), around which the sash (1) swings while attached to the positioning arm (5).

Figure 5:
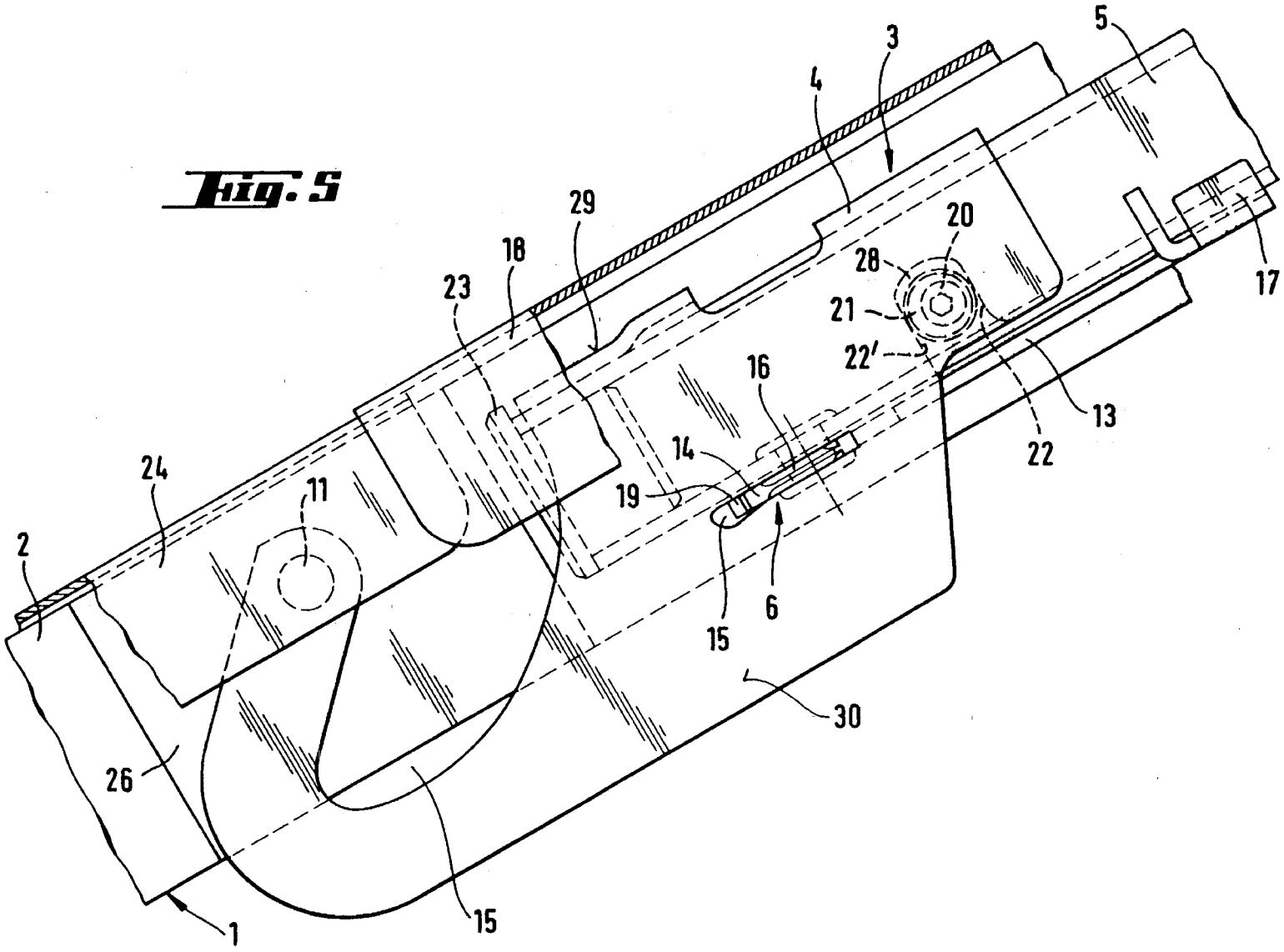
FIG. 5 is a fragmentary side elevational view of a third embodiment of a connection device.
Figure 6:
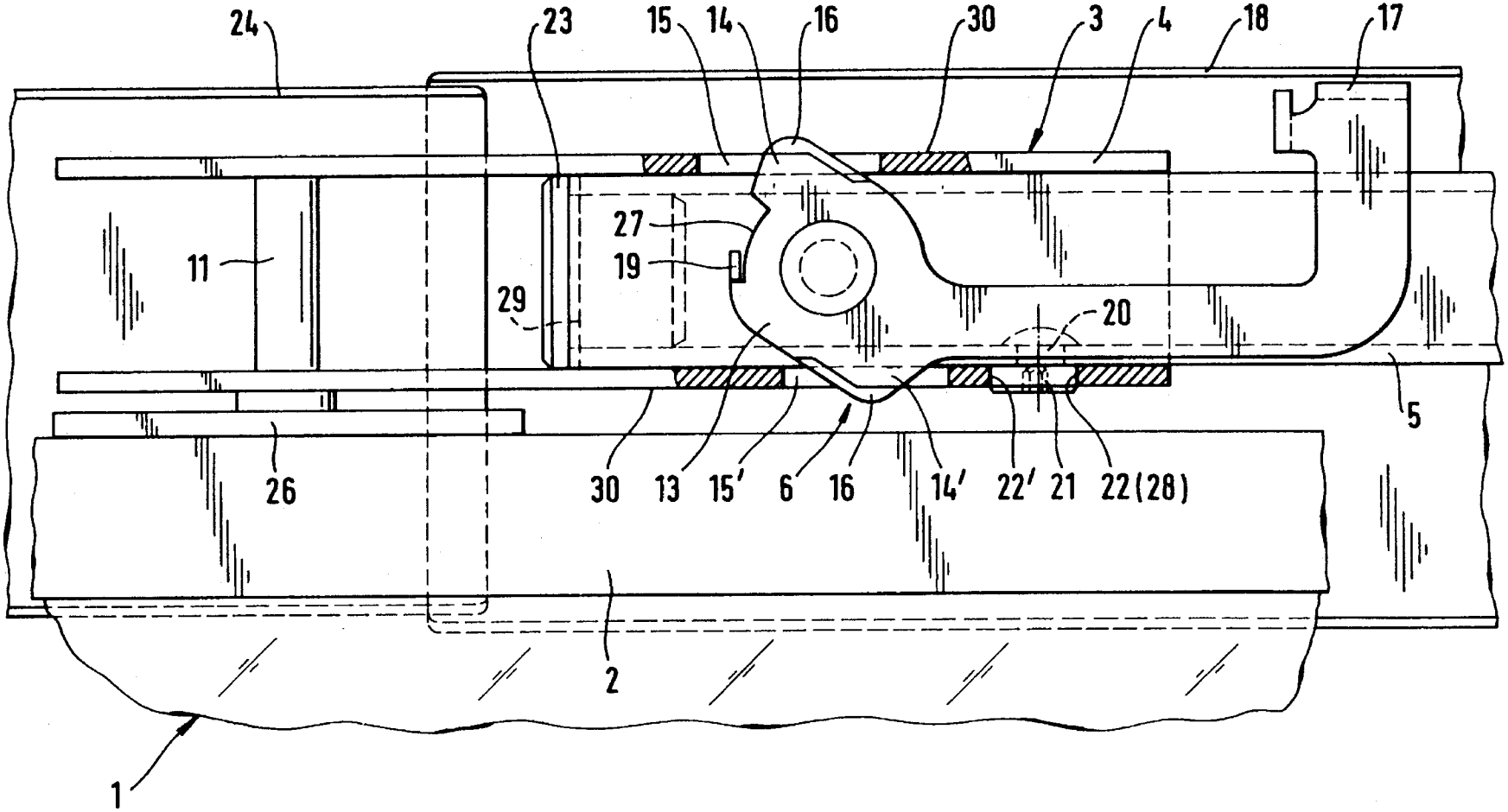
FIG. 6 is a bottom view of the third embodiment.

In the examples of embodiments in FIGS. 5 and 6, locking between the positioning arm (4) and connecting member (3) takes place by means of an attachment element (6), which is constructed as a swinging latch (13), which is mounted on the bottom side of the positioning arm (5). This latch (13) has two closing projections (14 and 14'), which in the locked position engage in corresponding slots (15, 15') in the side walls (30) of U-shaped body portion 4 of the connecting member (3). These slots (15, 15') are made in the form of elongated slots, and the closing projections (14, 14') have accurate cam surfaces (16) that serve for easy insertion or assure that the positioning arm (4) is also pressed with pushing moment against the bottom surface (29) of the U-shaped body portion (4). An insertion cam surface (19) on the positioning arm (5) engages with an arc shaped indentation in the latch (13) and limits its swinging motion. In FIG. 6, the swinging motion of the latch (13) is limited in the locked position.

The latch (13) has an activation handle (17), which protrudes sideways from the positioning arm 5, even in the locked position, and can thereby be reached easily. The upper weatherstripping (18), which also covers the positioning arm (5), is constructed in such a way that it also extends sideways over the activation handle. Swinging motion of the latch (13) is thereby prevented during mounting of the upper weatherstripping (18), so that, for safety reasons, unlocking between the connecting members (3) and the positioning arm (5) when the skylight has been installed in the roof cannot occur even accidentally.

Each connecting device is provided with an eccentric bolt (21) that has an eccentric shaft (20), which is brought to the inner side of the positioning arm (5) used for the sash (1) and engages in an elongated aperture (28) in the side wall (30) of the U-shaped body portion (4) of the connecting member (3), whereby the elongated aperture (28) has the limiting side edges (22, 22'). The function is as described above. This arrangement of the eccentric bolt (21) has the advantage that later adjustment of a skylight installed in the roof can be made easily from the inside.

Having thus described the invention, what is claimed is:

1. In a skylight:

(a) a casement;

(b) a sash having side rails for pivotal mounting in said casement; and (c) an assembly for installation of the sash into said casement for pivoting with respect thereto and including (i) a connecting member (3) pivotally engaged with said side rail of said sash and having a portion (4) of U-shaped cross section, (ii) a positioning arm (5) secured at one end to said casement and having the other end seated in said U-shaped portion of said connecting member, and (iii) a self-engaging coupling member coupling said other end of said arm and said connecting member, said coupling member being engageable and disengageable without tools.

2. The skylight in accordance with claim 1, wherein said coupling member includes bolts engaged in both said arm and said connecting member.

3. The skylight in accordance with claim 1 wherein said self-engaging coupling member includes in said other end of each positioning arm (5), at least one bolt (7), a biasing spring retained on said bolt biasing, said bolt outwardly of said arm, the outward portion of said bolt being seated in an aperture in said U-shaped portion of said connecting member (3), said bolt being biased inwardly of said arm upon movement of said arm inwardly over a tapered edge portion (10) of the connecting member (3) when the positioning arm (5) is inserted into the U-shaped portion (4) until it engages in the locked position in an aperture (9) in the connecting member (3).

4. The skylight in accordance with claim 1, wherein there is included latching means (13) on said positioning arm (5) releasably engageable with said connecting member (3) for holding said sash in a pivoted position.

5. The skylight in accordance with claim 4 wherein said latching means (13) includes a pivotable member with projecting portions (14, 14') which engage in apertures (15, 15') in said U-shaped portion (4) of said connecting member (3) in the locked position thereof.

6. The skylight in accordance with claim 5, wherein said apertures (15, 15') are elongated slots, and said locking projecting portions (14, 14') are each provided with cam surfaces (16).

7. The skylight in accordance with claim 5 wherein there is included a strike plate (19) on said positioning arm (5) which limits the pivoting of said latching means (13).

8. The skylight in accordance with claim 4 wherein there is included upper weatherstripping mounted at one end on said casement and extending over said connecting member and positioning arm, whereby, after installation of said sash (1), adjustment of said sash and latching of said latching means, said upper weatherstripping is engaged over said latching means to lock the assembly in the adjusted position.

9. The skylight in accordance with claim 1 wherein an eccentric bolt (21) seated in said positioning arm (5) adjacent said other end is engaged in an elongated aperture in said U-shaped portion of said connecting member (3) to provide an adjustable connection of said connecting member (3) with respect to said positioning arm (5).

10. The skylight in accordance with claim 9 wherein said eccentric bolt (21) is disposed between two limit surfaces (22, 22') in said connecting member (3) which extend perpendicularly to the longitudinal axis of said positioning arm (5), and the shank of said eccentric bolt (2) is mounted on said positioning arm (5) so that it can be rotated relative thereto.

11. The skylight in accordance with claim 1 wherein there is included an insert (23, 23') on said connecting member (3) which seats the end of said positioning arm to secure the assembled position of said connecting member (3) and said positioning arm (5).

12. The skylight in accordance with claim 1 wherein upper weatherstripping (18) covers said positioning arm (5) and extends over a lower weatherstripping (24) on said sash, and wherein said connecting member (3) has a recess (25) in its upper surface adjacent the upper end of said lower weatherstripping so that when said sash (1) pivots, said upper end of said lower weatherstripping (24) moves within said recess (25) in said connecting member (3).

* * * * *